United States Patent [19]

Pégourié

[11] 4,046,159

[45] Sept. 6, 1977

[54] PNEUMATIC LOGIC CIRCUITS AND THEIR INTEGRATED CIRCUITS

[76] Inventor: Jean-Pierre Pégourié, 3 Passage Bruyas, 34000 Montpellier, France

[21] Appl. No.: 620,257

[22] Filed: Oct. 7, 1975

[30] Foreign Application Priority Data

Oct. 8, 1974 France ..... 74.33822

[51] Int. Cl.[2] ..... F15C 1/10; F15C 1/12

[52] U.S. Cl. ..... 137/112; 137/269; 137/596.18; 137/625.66; 235/201 ME

[58] Field of Search ..... 137/112, 269, 596.18, 137/625.5, 625.66; 235/201 ME; 251/61.1

[56] References Cited

FOREIGN PATENT DOCUMENTS 1,043,846 9/1966 United Kingdom ..... 137/112

*Primary Examiner*—Alan Cohan
*Assistant Examiner*—Gerald A. Michalsky
*Attorney, Agent, or Firm*—Craig & Antonelli

[57] ABSTRACT

The pneumatic logic circuit is of generally symmetrical structure around an axis and symmetrical with respect to a median plane normal to this axis. It has a median plate provided with an axial passage and with a duct opening into this passage. On each side of the median plane is a diaphragm constituted by a flat sheet of rubber or of synthetic elastomer with, on its outer surface, a centering shoulder and with an axial cylindrical passage. It comprises axially a piston rod, passing freely through said passage of the median plate and with fluid-tightness through said passages of the diaphragm and bearing two pistons. On each side of the median plane is a bushing, bearing on the diaphragm and capping the centering shoulder thereof and allowing the piston to pass, each diaphragm being provided on its inner surface with an axial impression, comprising at the center a cylindrical chamber, whose diameter is a little greater than the diameter of said axial passage of the median plate, and a toric groove, separated from said cylindrical chamber by an annular lip with a flat profile capable of bearing against said median plate. These pistons each bear against the outer surface of the corresponding diaphragm. On each side of the median plane is an elastic diaphragm and a base applied against the corresponding bushing, and on each side a duct passes through the median plate and opens into the corresponding toric groove. The circuit is useful for numerical computers and control systems.

11 Claims, 10 Drawing Figures

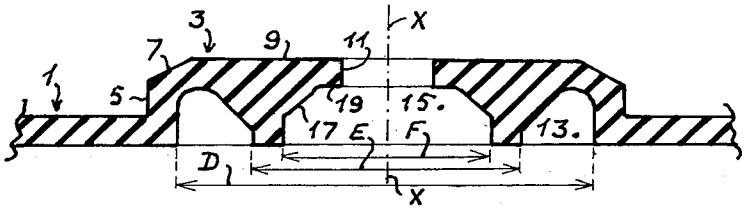
Fig 1
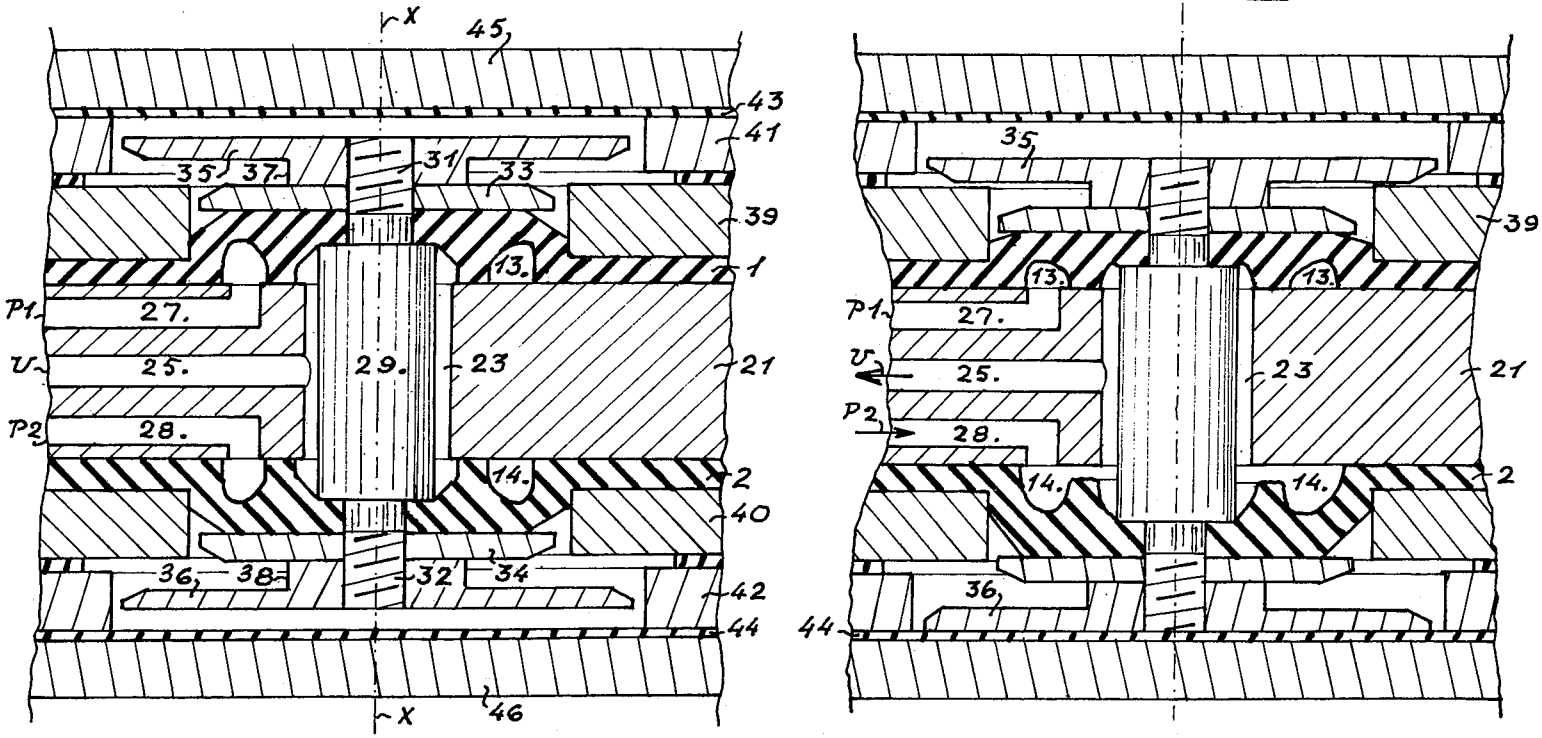
Fig 2
Fig 3

PNEUMATIC LOGIC CIRCUITS AND THEIR INTEGRATED CIRCUITS

BACKGROUND OF THE INVENTION

The invention relates to pneumatic logic circuits and more particularly to pneumatic logic circuits devised for forming into integrated circuits, that is to say into circuits each comprising a plurality of logic circuits cooperating for the obtaining of a result (numerical calculation, numerical recording, etc...); these logic circuits must hence ensure OR functions, NOT functions, AND functions, flip-flop or storage functions, or a portion only of such logic functions.

It is an object of the invention to provide such pneumatic logic circuits, which are of small size, which use the maximum of parts either interchangeable or common to various logic circuits of the same integrated circuit, and which in operation, do not require any other air-flow than that supplying the application (another logic circuit, an output to a processor, etc...).

SUMMARY OF THE INVENTION

The present invention provides a pneumatic logic circuit characterized in that it comprises, symmetrically around an axis, and generally symmetrically on each side of a median plate provided with an axial passage housing a piston rod of smaller diameter than that of the passage; a stamped resilient diaphragm member comprising an axial passage and, against the median plate, a toric groove; a piston fixed on said rod which passes with fluid-tightness into the axial passage of the stamped member and bearing against the stamped member; a bushing clamping the resilient diaphragm around the stamping; an elastic diaphragm and a base closing the whole.

Thus, the movable assembly, comprising the rod and the two pistons, can slide between three positions: a median position, in which the two toric grooves are closed; and two symmetrical positions, in each of which one toric groove is closed and the other toric groove communicates with the axial passage of the median plate. It then suffices to connect the utilization or user device to the axial passage of the median plate, and each of the two control pressures to a toric groove, to form the OR logic function. An integrated circuit formed from such OR pneumatic logic circuits, on the one hand will only comprise a single median plate and two resilient diaphragms, two bushings, two elastic diaphragms, and two bases, each of these parts being common to all the logic circuits, and on the other hand will only comprise identical movable assemblies.

In an advantageous embodiment of the invention, the abovesaid pneumatic logic circuit according to the invention can be provided, on each side of the median plate, with a second piston, fixed on the rod, of greater diameter than the first piston, and provided with a groove bearing on the first piston, and with a second bushing, placed on the first bushing and allowing the second piston to pass.

According to another advantageous embodiment of the invention, the abovesaid pneumatic logic circuit may be provided, on a single side of the median plate, with an axial cylindrical chamber, formed in a base against the corresponding elastic diaphragm, and of a diameter at least equal to that of the second piston.

It then suffices to connect the utilization or user device to the axial passage of the median plate, to connect the control pressure to the base chamber, to connect a supply pressure to the toric groove on the base chamber side, and to correct to exhaust the other toric groove, to form the NOT logic function.

According to yet another advantageous embodiment of the invention, the abovesaid pneumatic logic circuit may be provided, on the same side of the medium plate as the base bearing the chamber, with a frustoconic spring housed by means of its large base in a groove of the first bushing. It then suffices to connect the utilization or user device to the axial passage of the median plate, to connect one of the two control pressures to the base chamber and the other control pressure to the toric groove located at the opposite of the base chamber side, and to connect the other toric groove to exhaust, to form (under certain conditions regarding the strength of the frustoconic spring, as described below) the AND logic function.

According to the invention, the abovesaid pneumatic logic circuit may be provided, on each side of the median plate, with an axial cylindrical chamber, formed in the base against the corresponding elastic diaphragm, and of a diameter at least equal to that of the second piston, and, on a single side of the median plate, with a reversible frustoconic spring, housed by its small base in the groove of the second piston and housed by its large base in a groove of the second bushing. It then suffices to connect the user device to the axial passage of the median plate, to connect one of the two control pressures to a base chamber and the other control pressure to the other base chamber, to connect a supply pressure to the toric groove on the side opposite the frustoconic spring, and to connect to exhaust the other toric groove, to form (under certain conditions regarding the strength of the frustoconic spring, as described below) the flip-flop or storage logic function.

Thus, an integrated circuit, formed from such OR circuit and/or such NOT circuits and/or such AND circuits and/or such flip-flop or storage circuits, on the one hand will only comprise a single median plate and two resilient diaphragms, four bushings, two elastic diaphragms, and two bases, each of these parts being common to all of these logic circuits, and on the other hand will comprise only identical movable assemblies (except for the frustoconic springs).

BRIEF DESCRIPTION OF THE DRAWINGS

Some embodiments of the invention will now be described with reference to the accompanying drawings, given purely by way of non-limiting example. These drawings show axial sections on a very large scale (a scale of 5/1). In these drawings:

FIG. 1 shows a stamping of the resilient diaphragm employed in the logic circuit according to the invention;

FIG. 2 shows, in resting position, an OR pneumatic logic circuit according to the invention;

FIG. 3 shows, in working position, the OR circuit of FIG. 2;

DESCRIPTION OF THE PREFERRED EMBODIMENTS

Figure 5:
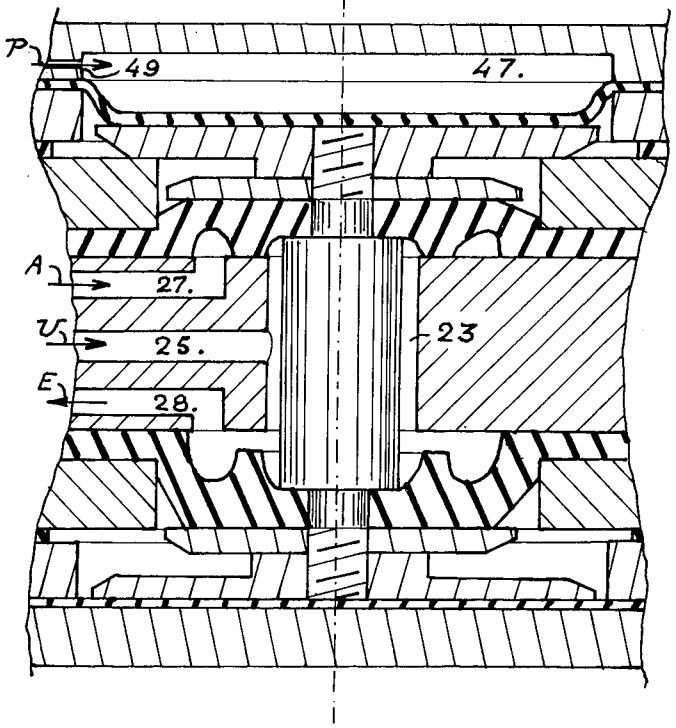
FIG. 5 shows, in working position, the NOT circuit of FIG. 4.

Referring to FIG. 1, which is a section through the axis X—X, the diaphragm 1 can be common to several logic circuits according to the invention; between logic circuits the diaphragm is a flat sheet, of rubber or of synthetic elastomers, which for each logic circuit comprises a shaped or stamped part 3, being a shape of revolution around an axis X—X; the stamped member 3 comprises, on one surface (the top surface in FIG. 1) a centering shoulder 5, surrounding a beveled edge 7 followed by a flat surface 9 with an axial cylindrical passage 11. On its other surface (the bottom surface in FIG. 1), the stamped member comprises a toric groove 13 with the axis X—X and with edges parallel to this axis, and at the center a cylindrical chamber 15, with an edge parallel to the axis X—X, followed by a chamfer 17 and by a flat surface 19 ending at the axial passage 11. The subsequent description will use the references: D for the outer diameter of the toric groove 13, E for the inner diameter of the groove, and F for the diameter of the chamber 15, hence with $D>E>F$.

Referring to FIG. 2, which is a section passing through the axis X—X of the logic circuit according to the invention: this structure is in general a structure of revolution around the axis X—X and symmetrical with respect to a median plane at right angles to the axis X—X. For clarity in the description, two thus symmetrical arrangements will receive respectively, the one (that at the top in the Figure) an odd reference number and the other (that below in the Figure) the consecutive even referene number. A median plate 21 is provided with central passage 23, of diameter a little smaller than the abovesaid diameter F, into which a duct 25 opens, and two ducts 27 and 28 opening into the grooves 13 and 14 of two diaphragms 1 and 2 such as those already described. It is pointed out that the representation of the ducts 25, 27 and 28 is diagrammatic; these ducts are in fact arranged according to questions of choice and/or opportunity. The movable assembly comprises a piston rod, formed by a cylindrical central body 29, of distinctly smaller diameter than the passage 23 in which it is placed and by two cylindrical shanks 31, 32. The flanges or end-faces of the body 29 bear against the surfaces 19 and 20 of the diaphragms 1 and 2, and the cylindrical parts of the shanks are borne within the axial passages 11 and 12 of the diaphragms 1 and 2, thereby ensuring the fluid-tightness of these passages. On the shank 31 (or 32) are fixed, thereby slightly compressing the diaphragm 1 (or 2) a first piston 33 (or 34), bearing against the surface 9 (or 10) of the diaphragm 1 (or 2) then a second piston 35 (or 36) with a groove 37 (or 38) bearing against the first piston, this second piston having a diameter distinctly greater than that of the first piston. This fixing of the two pistons on the shank of the rod may be effected by a retaining ring or by a spring washer called a clip or again by screwing the second piston onto the threaded end of the shank (as shown).

The stamped diaphragm member 1 (or 2) is centered by a first bushing 39 (or 40) capping its centering shoulder 5 (of 6) and allowing the first piston 33 (or 34) to pass, after a fluid-tight seal, a second bushing 41 (or 42) allows the second piston 35 (or 36) to pass. Finally, a flat elastic diaphragm 43 (or 44) and a base 45 (or 46) are applied against the second bushing 41 (or 42) and enclose the whole.

The manner in which the logic circuit, which has just been described with reference to FIG. 2, can operate as an "OR" logic circuit, will now be described; that is to say according to the following truth table:

| P1 | P2 | U |
|---|---|---|
| 0 | 0 | 0 |
| 1 | 0 | 1 |
| 0 | 1 | 1 |
| 1 | 1 | 1 |

in which P1 and P2 are two control pressures, and U the pressure delivered by the OR logic circuit to the output or application (another logic circuit, processor etc.). The pressure P1 and P2 are respectively applied to the ducts 27 and 28, and the user device U is connected to the duct 25. If the two control pressures P1 and P2 are zero, the movable assembly remains in resting position which is that shown in FIG. 2, by reason of the slight pre-compression of the diaphragms 1 and 2, and the user device U at 25 is not supplied. If now a control pressure is applied, for example the control pressure P2 through the duct 28, the latter conducts it into the toric groove 14 where it is exerted on the surface ($\pi D^2 - \pi E^2$); it causes the movable assembly to drop, and as soon as the center of the diaphragm 2 separates from the median plate 21, the pressure is exerted on the surface ($\pi D^2 - \pi F^2$)which is larger, which ensures a free movement of the movable assembly until the abutment of the piston 36 against the diaphragm 44 (as shown in FIG. 3) and/or of the piston 35 against the bushing 39. In this working position, the pressure P2 through 28 - 14 - 23 - 25, supplies the user device U. If now, a control pressure P1 is applied through the duct 27, it is exerted in the groove 13 under surface $\pi D^2 - \pi F^2$), which is smaller than the surface ($\pi D^2 - \pi F^2$), and it hence remains without effect. The operation will be exactly symmetrical (ascent of the movable assembly into working position) if the pressure P1 is applied before the pressure P2.

It will be noted that, at each moment of operation, the sources of pressure (P1 and/or P2) do not deliver anything more than (when appropriate) the supply of the user device U.

It will again be noted that, for the abovesaid operation as an OR logic circuit, the second pistons 35 and 36 and the second bushings 41 and 42 can be eliminated. However, as described below, these parts are used in other logic circuits: the structure described above enables, in an integrated circuit comprising these other logic circuits, the use for the assembly of logic circuits, of the maximum of common parts (bushings) and of interchangeable parts (pistons).

Figure 4:
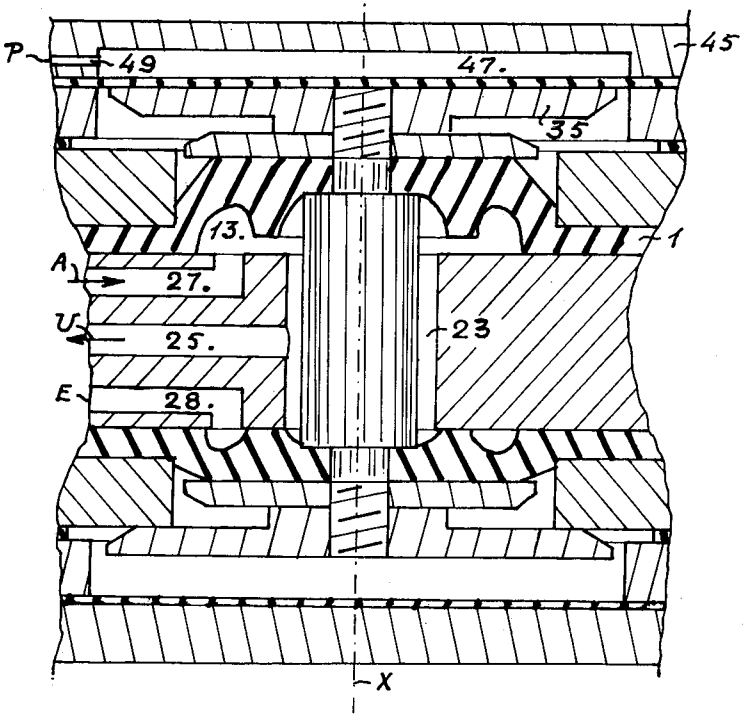
FIG. 4 shows, in resting position, a NOT pneumatic logic circuit according to the invention.

The logic circuit according to the invention shown in FIG. 4 does not differ from that according to the FIG. 2 except that one of the bases, for example the base 45 as shown, is provided with an axial cylindrical chamber 47, of diameter at least equal to that of the second piston 35, with a duct 49 opening therein. This circuit can operate as a "NOT" logic circuit, in other words as an inverter, that is to say according to the following truth table:

| P | U |
|---|---|
| 0 | 1 |
| 1 | 0 |

in which P is the control pressure, and U the pressure sent through the logic circuit to the user device (other logic circuit, processor, etc...). The control pressure P is applied to the duct 49, a supply pressure A is applied to the duct 27, the user device U is connected to the duct 25, and the duct 28 is connected to exhaust E. FIG. 4 shows the NOT circuit in the resting state: the control pressure P being zero, the supply pressure A raises the movable assembly, and, through the axial passage 23 and the duct 25 passes to the user device U. FIG. 5 shows the NOT circuit in the working state: the control pressure P acts in the chamber 47 on a surface greater than the surface on which the supply pressure A acts, and the movable assembly drops, connecting the user U, through 25 - 23 - 28, to the exhaust E.

Here also, the pressure source A delivers nothing more than (when appropriate) the supply of the user device U (the source P does not deliver anything).

Figure 7:
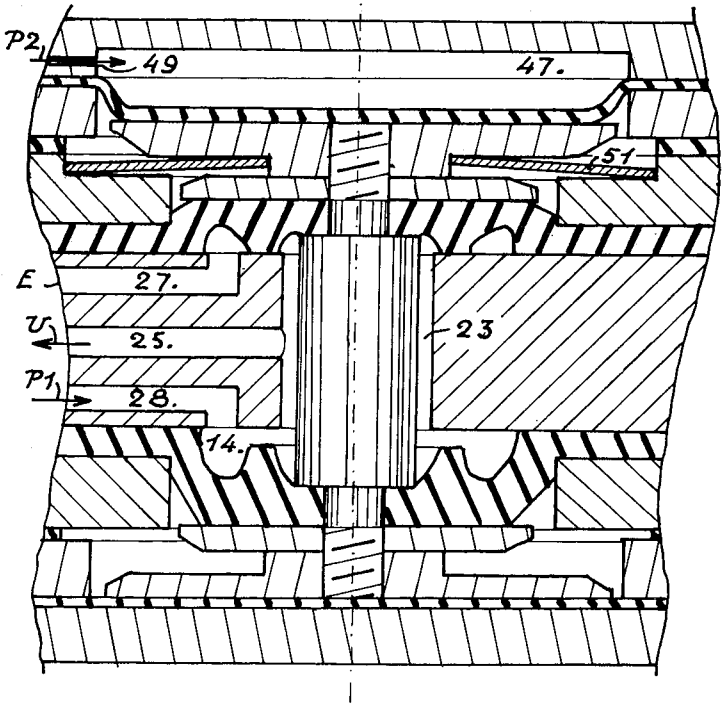
FIG 7 shows, in working position, the AND circuit of FIG. 6.
Figure 6:
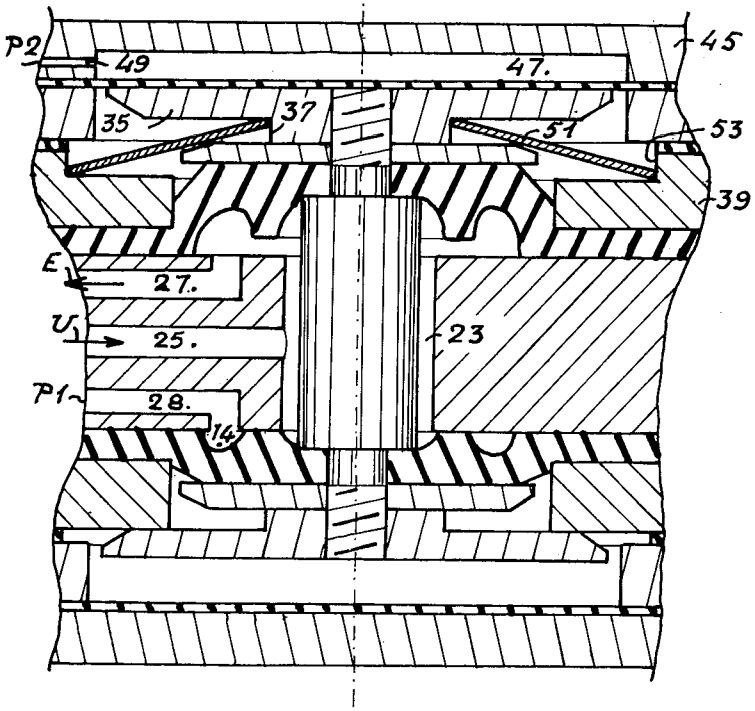
FIG. 6 shows, the resting position, and AND pneumatic logic circuit according to the invention.

The logic circuit according to the invention shown in FIG. 6 does not differ from that shown in FIG. 4 except by the addition of the frustoconic spring 51. This frustoconic spring works on flattening by exerting a variable force always in the same direction (always upwards in FIG. 6). The small base of the frustoconic spring 51 is housed in the groove 37 of the second piston 35, and its large base is housed in a groove 53 of the first bushing 39. This circuit can operate as an "AND" logic circuit, that is to say according to the following truth table:

| P1 | P2 | U |
|---|---|---|
| 0 | 0 | 0 |
| 1 | 0 | 0 |
| 0 | 1 | 0 |
| 1 | 1 | 1 |

in which P1 and P2 are the two control pressures, and U the pressure sent through the logic circuit to the user device. One of the control pressures, for example P1, is applied to the duct 28 (side opposite to the chamber 47), the other control pressure, P2, is applied to the duct 49, the user device U is connected to the duct 25, and the duct 27 (side of the chamber 47) is connected to the exhaust E. FIG. 6 shows the AND circuit in the resting state (3 cases according to the truth table), the spring 51 holding the movable assembly raised: either the two control pressures P1 and P2 are zero; or the pressure P2 is zero and the pressure P1 is exerted in the toric groove 14 but there develops a force (downwards) less than the force of the spring 51; or the pressure P1 is zero and the pressure P2 exerted in the cylindrical chamber 47 develops here a force (downwards) greater than the force of the spring 51, which causes the movable assembly to pass into low position, but the user device U is thus connected through 23 to the pressure P1 which is zero. Lastly, if the two control pressures P1 and P2 are exerted in the chambers 14 and 47 (FIG. 7) the sum of their forces (downwards) is greater than the force of the spring 51 and the movable assembly passes into low position, the pressure P1 supplying, through 28 - 23 - 25, the user device U.

Here also, the source P1 delivers nothing more than (when the occasion arises) the supply of the user device U (the source P2 delivers nothing).

Figure 9:
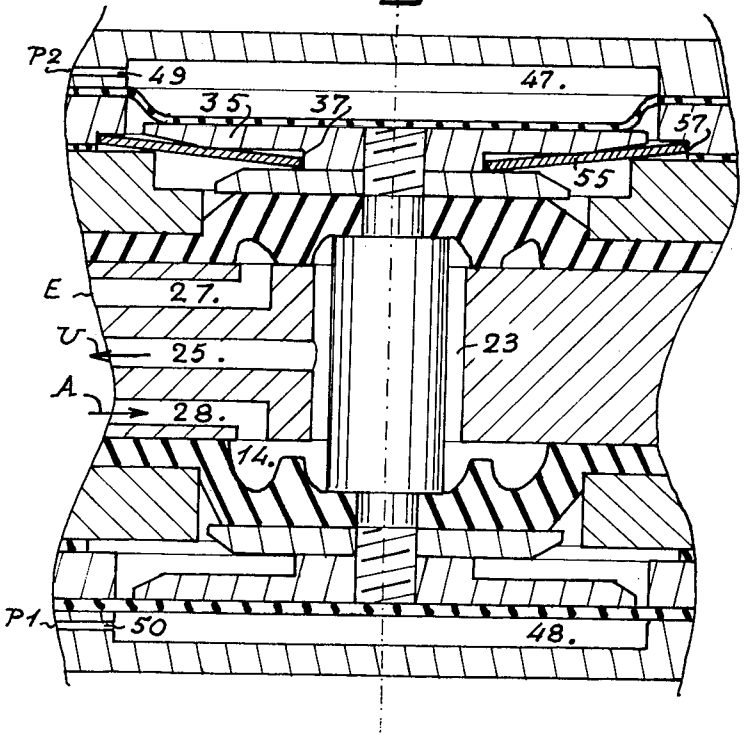
FIGS. 8 and 9 show, respectively in working positions I and II, a flip-flop or storage logic circuit according to the invention.
Figure 8:
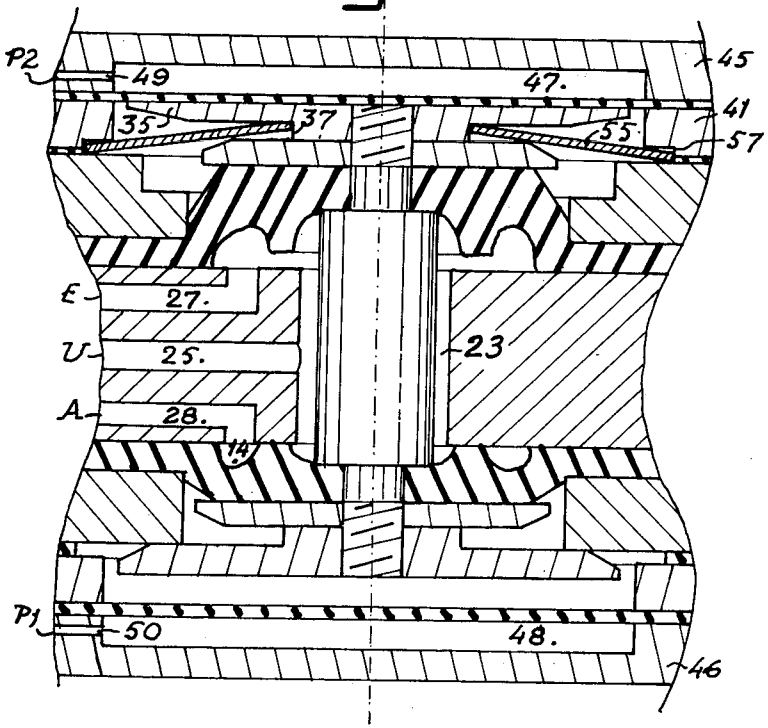

The logic circuit according to the invention shown in FIGS. 8 and 9 only differs from that according to FIG. 2 in that the two bases 45 and 46 are each provided with an axial cylindrical chamber 47 or 48, of a diameter at least equal to that of the second piston 35 or 36, with a duct 49 or 50 opening therein, and by the addition of a frustoconic spring 55. This frustoconic spring is reversible as seen in FIGS. 8 and 9, and it supplies an axial force directed from its large base towards its small base, that is to say upwards in FIG. 8 and downwards in FIG. 9. The small base of the frustoconic spring 55 is housed in the groove 37 of the second piston 35, and its large base is housed in the groove 57 of the second bushing 41. This circuit can operate as a bistable, or flipflop, or storage, that is to say according to the following truth table:

| | P1 | P2 | U |
|---|---|---|---|
| ↓ | 1 | 0 | 0 |
| | 0 | 0 | 0 |
| | 0 | 1 | 1 |
| | 0 | 0 | 1 |
| ↓ | 1 | 0 | 0 |
| | \| | \| | \| |
| | \| | \| | \| |
| ↓ | \| | \| | \| |

in which P1 and P2 are the two control pressures, and U the pressure sent by the logic circuit to the user device. The control pressure P1 is applied to the duct 50, the control pressure P2 is applied to the duct 49, a permanent supply A is applied to the duct 28, the user device U is connected to the duct 25, and the duct 27 is connected to the exhaust E. FIG. 8 shows the working position I: the frustoconic spring 55 exerts a force (directed upward to the Figure) greater than that developed by the supply pressure A in the toric groove 14, the movable assembly is in upper position and connects the user device U, through 25 - 23 - 27, to the exhaust E. To pass from the position I to position II, the control pressure P2, through the duct 49, is applied in the chamber 47, where it develops a force which, increased by the force develop by the supply pressure A in the toric groove 14, is greater than the fore of the frustoconic spring 55. The movable assembly tilts into lower position (FIG. 9), that is to say into position II by reversing the reversible frusto-conic spring 55, which exerts a force directed downwardly (in FIG. 9); the supply A, through 28 - 23 - 25, places the user device U under pressure. To pass from the position II to the position I, the control pressure P1 and through duct 50, is applied in the chamber 48, where it develops a force which is greater than the force of the spring 55 increased by the force developed by the supply pressure A in the toric groove 14; the movable assembly tilts into upper position, that is to say into position I (FIG. 8) already described.

Here also, the supply A delivers nothing more than (in position II) for the user device U (the sources P1 and P2 deliver nothing).

As is obvious to the technician skilled in the art, the structures which have been described above also permit the performance of other logic functions according to questions of choice and opportunity. For example, the bistable storage according to FIG. 8 and 9, if the pressures disappear, remains in the position where it was; it may be desired on the contrary that in the case of disappearance of pressures the flipflop should remain or come back into a selected position. For example, in order that in the case of disappearance of the pressures, the flipflop should remain or return to position I, it suffices to modify the dimensions of the frustoconic spring and of the grooves housing it, so that the frustoconic spring alone no longer suffices to hold the position II (but the holding of the latter requires the cooperation of the spring and of the supply pressure in the toric groove 14 of FIG. 9). A "safety" bistable storage is thus obtained, that is to say having a single and predetermined position in the case of disappearance of the pressures. For example again, it is possible to obtain a logic locking function by taking as the locking pressure one of the two control pressures of the AND circuit according to FIGS. 6 and 7 (it is then the absence of locking pressure which locks the AND circuit). It is also possible to obtain this logic locking function by employing the NOT circuit according to FIGS. 4 and 5, the pressure controlling the locking being applied in the chamber 47, the control pressure being applied in the toric groove 13, the user device being connected to the duct 25, and the duct 28 being connected to the exhaust. For example again, it is possible to produce a switching function by applying, without a frustoconic spring, the circuit according to FIGS. 8 and 9, the control pressures being applied in the base chambers, the input being connected to the duct 25, and the toric grooves being connected to the outputs.

It is also quite clear that it is possible to produce an AND function by means of an AND circuit (FIGS. 6 and 7) and of a NOT circuit FIGS. 4 and 5), and OR function by means of an OR circuit (FIGS. 2 and 3) and of a NOT circuit, etc. . .

The structure of the logic circuits which have been described permits their construction into integrated circuits; a single integrated circuit part constitutes the median parts of all these logic circuits.

Figure 10:
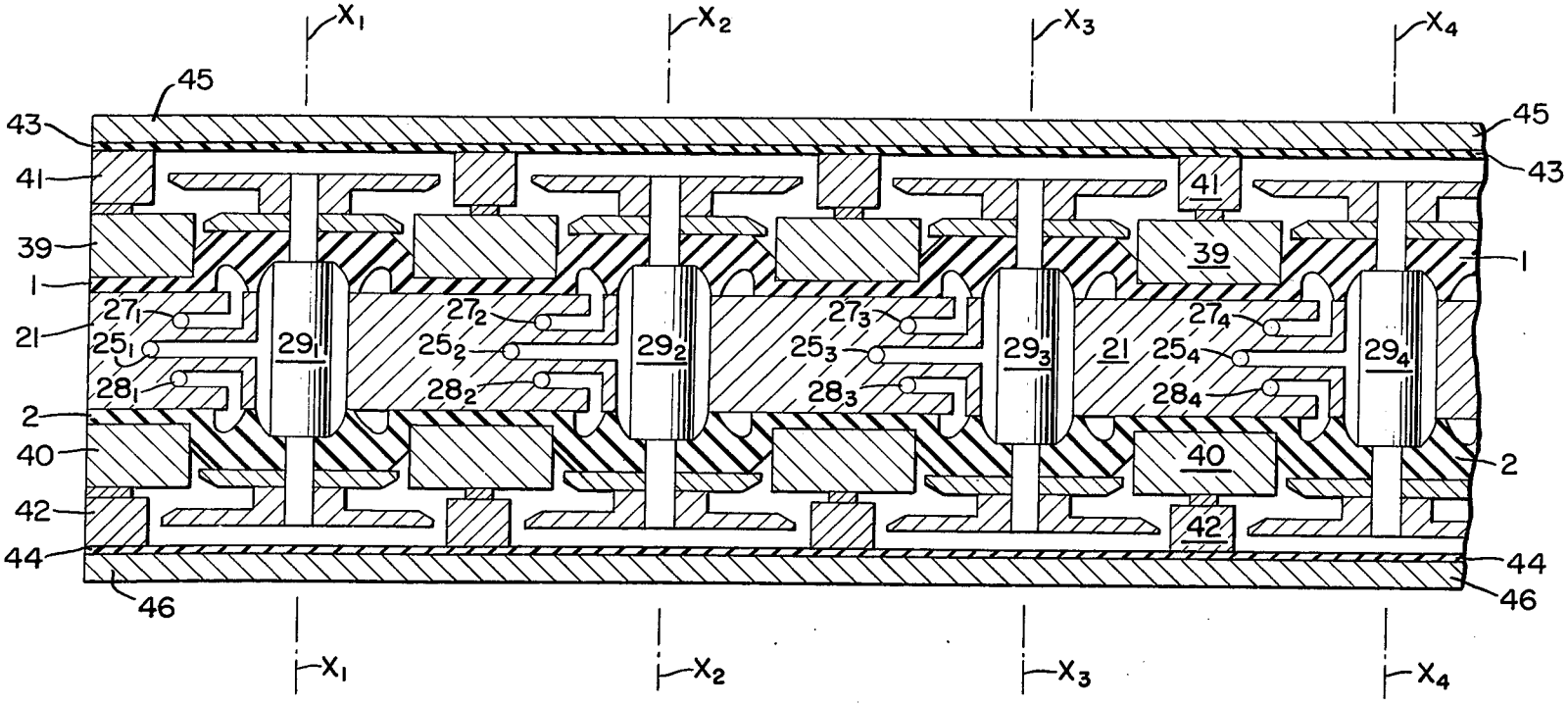
FIG. 10 illustrates a plurality of OR pneumatic logic circuits integrated in common within the same body.

To this end, FIG. 10 illustrates the manner in which a plurality of pneumatic OR circuits may be integrated together in the same body. Basically, FIG. 10 shows the manner in which circuits such as the OR circuits of FIGS. 2 and 3 may be integrated within the same body having a common base 45, 46 and a flat elastic diaphragm 43, 44. Each respective OR-logic circuit has an axis $X_1$, $X_2$, $X_3$ and $X_4$, corresponding to the axes shown in FIGS. 2 and 3. The reference numerals corresponding to the same parts as FIGS. 2 and 3 are likewise used in FIG. 10. In addition, FIG. 10 shows respective ducts $27_1 \ldots 27_4$, $25_1 \ldots 25_4$, and $28_1 \ldots 28_4$ corresponding to the individual ducts 27, 25 and 28 in FIGS. 2 and 3. Each respective circuit employs a cylindrical central body $29_1 \ldots 29_4$, respectively, through which the respective $X_1$ -$X_4$ pass. Individual circuits operate in the same fashion as described in connection with FIGS. 2 and 3, discussed previously. As can be seen from the illustration shown in FIG. 10, integration of the individual pneumatic circuits into a common body offers a considerable advantage of the invention. Moreover, the logic circuits according to the invention have, without even seeking miniaturization, particularly reduced sizes, for example a thickness (parallel to the axis X—X) of the order 3 cm, and a diameter a little smaller; an integrated circuit using them in hence light of and of little bulk.

What I claim is:

1. Pneumatic logic circuit of generally symmetrical structure around an axis and symmetrical with respect to a medium plane normal to this axis, comprising a median plate provided with an axial passage and with a duct opening into this passage, comprising on each side of the median plane a diaphragm made of a flat sheet of elastomer with, on its outer surface, a centering shoulder and with an axial cylindrical passage, comprising axially a piston rod, passing freely through said passage of the median plate and with fluid-tightness through said passages of the diaphragms and bearing two pistons, and comprising on each side of the median plane a bushing, bearing on the diaphragm and capping the centering shoulder thereof and allowing the piston to pass, each diaphragm being provided on its inner surface with an axial impression, comprising at the center a cylindrical chamber, whose diameter is a little greater than the diameter of said axial passage of the median plate, and a toric groove, separated from said cylindrical chamber by an annular lip with a flat profile capable of bearing against said median plate, and pistons each bearing against the outer surface of the corresponding diaphragm, said logic circuit comprising on each side of the median plane an elastic diaphragm and a base applied against the corresponding bushing, and on each side a duct passing through the median plate and opening into the corresponding toric groove.

2. Pneumatic logic circuit according to claim 1, comprising, symmetrically on each side of said median plate:

a second piston, fixed on the road, of greater diameter then the first piston, and provided with a groove bearing against the first piston, a second bushing, placed on the first bushing and allowing the second piston to pass.

3. Pneumatic logic circuit according to claim 2, wherein one of the two bases is provided, against its elastic diaphragm, with an axial cylindrical chamber, of a diameter at least equal to that of the second piston, with a duct opening into this chamber.

4. Pneumatic logic circuit according to claim 3, comprising, on the same side of the median plate as the chamber base, a frustoconic spring, housed by its small base in the groove of the second corresponding piston and housed by its large base in a groove of the first corresponding bushing.

5. Pneumatic logic circuit according to claim 4, adapted for use as an AND logic function having two control pressures and controlling a user device, wherein one of the control pressures is applied to the duct opening into the toric groove on the side opposite the cylindrical base chamber, the other control pressure is applied to the duct opening into the base chamber, the user device is connected to the duct opening into the axial passage of the median plate, and the duct opening into the other toric groove is connected to exhaust, the frustoconic spring having a force greater than the force exerted by the control pressure in the toric groove on the side opposite the cylindrical base chamber and less than the sum of the two forces exerted by the two control pressures respectively in this toric groove and in this cylindrical base chamber.

6. Pneumatic logic circuit according to claim 3, adapted for use as a NOT logic function, wherein a control pressure is applied to the duct opening into the base chamber, a supply pressure is applied to the duct opening into the toric groove on the base chamber side, the user device is connected to the duct opening into the axial, passage of the median plate, and the duct opening into the other toric groove is connected to exhaust.

7. Pneumatic logic circuit according to claim 2, wherein on each side of the median plate the corresponding base is provided, against its elastic diaphragm, with an axial cylindrical chamber, of diameter at least equal to that of the second piston, with a duct opening into the chamber, and on one side only of the median plate a frustoconic spring housed by its small base in the groove of the corresponding second piston and by its large base in a groove of the corresponding second bushing.

8. Pneumatic logic circuit according to claim 7, adapted for use as a flip-flop or storage logic function having two control pressures and controlling a user device, wherein the two control pressures are applied to the ducts opening into the base chambers, a supply pressure is applied to the duct opening into the toric groove on the side opposite to the frustoconic spring, the user device is connected to the duct opening into the axial passage of the median plate, and the duct opening into the other toric groove is connected to exhaust, the frustoconic spring being reversible and having, at one time, a force opposing the force developed by the supply pressure in the corresponding toric groove, greater than this force, and less than the sum of this force and the force developed by a control pressure in the spring side base chamber, and at other times a force in the same direction as the force developed by the supply pressure in the corresponding toric groove, the sum of these two forces being less than the force developed by the other control pressure in the base chamber on the side opposite the spring.

9. Pneumatic logic circuit according to claim 7, adapted for use as a safety flip-flop or storage logic function having two control pressures and controlling a user device, wherein the two control pressures are applied to the ducts opening into the base chambers, a supply pressure is applied to the duct opening into the toric groove on the side opposite to the frustoconic spring, the user device being connected to duct opening into the axial passage of the median plate and the duct opening into the other toric groove is connected to exhaust, the frustoconic spring having, at one time a force greater than the force developed by the supplying pressure in in the corresponding toric groove and less than the sum of this force and of the force developed by a control pressure in he base chamber on the spring side, and at other times a force less than the force developed by the supply pressure in the corresponding groove.

10. Pneumatic logic circuit according to claim 1, used in the OR logic function having two control pressures and controlling a user device, wherein each of the two control pressures is applied to one of the two ducts each opening into the toric groove of one impression, and the user device is connected to the duct opening into the axial passage of the median plate.

11. Pneumatic integrated circuit, comprising a plurality of OR circuits according to claim 10, wherein their median plates and, on each side of their median plates, their impressed diaphragms, their bushings, their elastic diaphragms, and their bases, are integrated in common.

* * * * *